US011877606B2

(12) United States Patent
Fleming

(10) Patent No.: US 11,877,606 B2
(45) Date of Patent: Jan. 23, 2024

(54) LOWER BODY GARMENT WITH AN INTEGRATED RESISTANCE BAND

(71) Applicant: Pamela Joyce Fleming, Flagstaff, AZ (US)

(72) Inventor: Pamela Joyce Fleming, Flagstaff, AZ (US)

( * ) Notice: Subject to any disclaimer, the term of this patent is extended or adjusted under 35 U.S.C. 154(b) by 210 days.

(21) Appl. No.: 17/555,198

(22) Filed: Dec. 17, 2021

(65) Prior Publication Data

US 2022/0192283 A1 Jun. 23, 2022

Related U.S. Application Data

(63) Continuation-in-part of application No. 29/762,698, filed on Dec. 17, 2020, now Pat. No. Des. 960,509.

(60) Provisional application No. 63/127,023, filed on Dec. 17, 2020.

(51) Int. Cl.

| | |
|---|---|
| ***A41D 13/00*** | (2006.01) |
| ***A63B 21/055*** | (2006.01) |
| ***A41D 1/08*** | (2018.01) |
| ***A63B 21/00*** | (2006.01) |
| ***A41D 31/18*** | (2019.01) |
| ***A63B 21/04*** | (2006.01) |

(52) U.S. Cl.

CPC ..... *A41D 13/0015* (2013.01); *A41D 1/08* (2013.01); *A41D 31/18* (2019.02); *A63B 21/0428* (2013.01); *A63B 21/0555* (2013.01); *A63B 21/4011* (2015.10)

(58) Field of Classification Search

CPC ..... A41D 13/0015; A41D 1/08–089; A41D 1/14; A41D 31/18; A63B 21/0555; A63B 21/4011–4013; A63B 21/0552; A63B 21/4025; A63B 21/04–0435; A63B 21/055–0557; A63B 69/0059; A63B 69/0062; A63B 69/0057

See application file for complete search history.

(56) References Cited

U.S. PATENT DOCUMENTS 5,267,928 A 12/1993 Barile et al.
5,357,637 A * 10/1994 Moore ..... A41D 31/18 482/121
6,047,405 A * 4/2000 Wilkinson ..... A63B 21/4009 2/69

(Continued)

FOREIGN PATENT DOCUMENTS

WO 201915727 A1 1/2019

*Primary Examiner* — Garrett K Atkinson
*Assistant Examiner* — Kathleen M Fisk

(57) ABSTRACT

A lower body garment with an integrated resistance band is an apparatus that provides constant resistance for the lower body of a user throughout a workout. The apparatus includes a lower body garment and a resistance band. The lower body garment covers the lower body of the user and positions the resistance band around the thighs. The resistance band applies resistance throughout each movement and position of the legs. The lower body garment may extend to the ankles, the knees, or just above the knees. The apparatus further includes an inner left piece and an inner right piece to completely surround and enclose the legs while positioned within both the lower body garment and the resistance band. The apparatus may further include a skirt portion in order to appear as if a user is only wearing a skirt or to further accent the lower body garment.

15 Claims, 7 Drawing Sheets

(56) References Cited

U.S. PATENT DOCUMENTS

| | | | | |
|---|---|---|---|---|
| 6,363,538 | B1 * | 4/2002 | Davis | A41D 1/089 2/238 |
| 9,192,806 | B2 * | 11/2015 | Mial | A63B 21/00069 |
| 10,118,063 | B2 * | 11/2018 | DeYoung | A63B 21/00 |
| 10,398,619 | B2 * | 9/2019 | Crombie | A63B 21/068 |
| 10,857,414 | B1 * | 12/2020 | Lopez | A63B 21/4035 |
| 10,874,898 | B1 * | 12/2020 | Torres | A63B 21/0552 |
| 2010/0130903 | A1 * | 5/2010 | Rock | D04B 1/243 602/62 |
| 2019/0133215 | A1 * | 5/2019 | Whalen | A63B 21/4011 |
| 2019/0351278 | A1 * | 11/2019 | Walker | A63B 21/00061 |

* cited by examiner

LOWER BODY GARMENT WITH AN INTEGRATED RESISTANCE BAND

The current application claims a priority to the U.S. Provisional Patent application Ser. No. 63/127,023 filed on Dec. 17, 2020.

The current application is also a continuation-in-part (CIP) application of the U.S. design application serial number 29/762,698 filed on Dec. 17, 2020.

FIELD OF THE INVENTION

The present invention generally relates to exercise clothing. More specifically, the present invention is a lower body garment with an integrated resistance band.

BACKGROUND OF THE INVENTION

In recent times, exercising has become a growing activity throughout the world. More specifically, exercising with resistance bands has been on an upwards trend due to the need to stay indoors from the current pandemic. There exist many different resistance bands that are currently used for leg exercises. The problem with existing resistance bands that targets the leg of the user is that when used, the resistance band can become loose and slip off of the user's leg. The said situation occurs when the user does not apply enough force to hold the resistance band around the legs for a split second. The constant action of needing to readjust the resistance band around the legs can be time consuming and irritating.

An objective of the present invention is to provide a pair of leggings that are uniquely designed for exercising and working out. The present invention is a two-in-one item that fuses a pair of leggings together with a resistance band. In addition, the present invention is a pair of leggings that has a built-in resistance band.

DETAILED DESCRIPTIONS OF THE INVENTION

Figure 1:
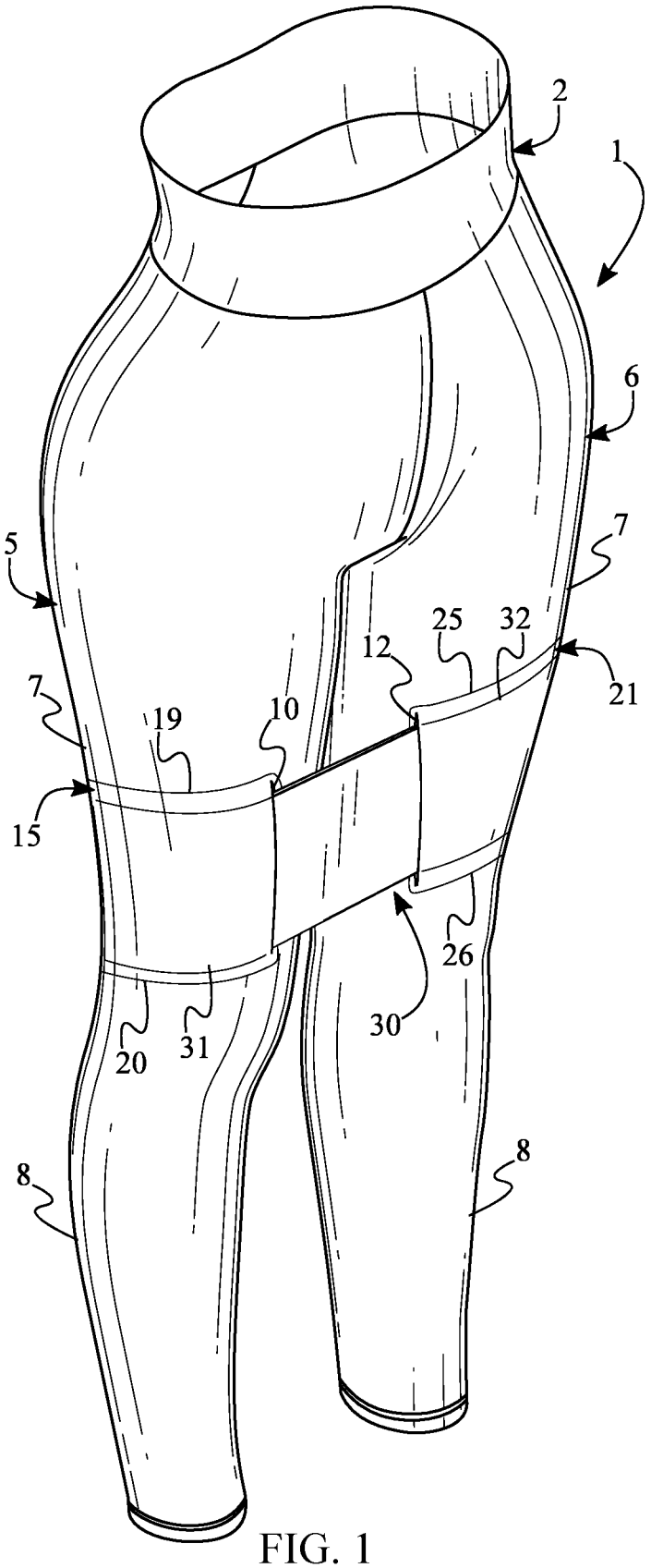
FIG. 1 is a perspective view of a preferred embodiment of the present invention.

All illustrations of the drawings are for the purpose of describing selected versions of the present invention and are not intended to limit the scope of the present invention.

The present invention is a lower body garment with an integrated resistance band. The present invention enhances exercises that targets hamstrings, glutes, quadriceps, and calves. The present invention also engages abdominal muscles throughout a variety of exercise and provides slight compression for a smooth fit. Moreover, the present invention eliminates the need to put on, take off and position a resistance band, before and after a workout. The present invention comprises a lower body garment 1 and a resistance band 30, seen in FIG. 1, FIG. 2, FIG. 3, FIG. 5, and FIG. 6. The lower body garment 1 is preferably work during a workout or exercise that allows a user to complete the workout or exercise while maintain proper form. In the preferred embodiment of the present invention, the lower body garment 1 provides slight compression around the lower body and abdominal regions. The lower body garment 1 allows for a wide range of movements and fully mobility. In order for a user to wear the lower body garment 1, the lower body garment 1 comprises an abdomen portion 2, a left leg portion 5, a right leg portion 6, a first left slit 9, a second left slit 10, a first right slit 11, and a second right slit 12. The abdomen portion 2 surrounds the abdomen region. The left leg portion 5 surrounds the left leg, the right leg portion 6 surrounds the right leg. The first left slit 9 and the second left slit 10 provide passage of the resistance band 30 through the left leg portion 5. Similarly, the first right slit 11 and the second right slit 12 provide passage of the resistance band 30 through the right leg portion 6. Moreover, the first left slit 9, the second left slit 10, the first right slit 11, and the second right slit 12 secures the position of the resistance band 30 around the legs of the user and maintains a flat and smooth arrangement of the resistance band 30 against the legs of the user. The resistance band 30 applies resistance against the legs of the user throughout movements made or positions held throughout an exercise. The resistance band 30 may comprise various levels of resistance depending on the level of strength of the user. In alternate embodiments of the present invention, the resistance band 30 may comprise a visual indicator such as a design or color to indicate the level of resistance of the resistance band 30.

The overall configuration provides constant resistance with each position and movement of the legs of a user while maintaining the comfortability of a user. The lower body garment 1 conforms to the shape of the body of a user as the left leg portion 5 is positioned adjacent with the right leg portion 6. The abdomen portion 2 is positioned adjacent with the left leg portion 5 and the right leg portion 6, seen in FIG. 1, FIG. 2, FIG. 3, FIG. 5, and FIG. 6. This arrangement allows the user to put on the lower body garment 1 by simply positioning each leg through the abdomen portion 2 until the left leg and the right leg are fully positioned within the left leg portion 5 and the right leg portion 6, respectively. Furthermore, the abdomen portion 2 is smoothly wrapped around the abdomen region of the user. The lower body garment 1 is a single piece of attire as the abdomen portion 2 is terminally fixed around the left leg portion 5. Likewise, the abdomen portion 2 is terminally fixed around the right leg portion 6. In order for the resistance band 30 to be positioned around both legs of the user, specifically the front, the outer side, and the back of the left leg of the user, the first left slit 9 is positioned offset from the second left slit 10 about the left leg portion 5. The first left slit 9 and the second left slit 10 traversing into the left leg portion 5, thereby ensuring the position of the resistance band 30 around the front, the outer side, and the back of the left leg and reducing any crumpling of the resistance band 30 throughout use. Similarly, the resistance band 30 is positioned around both legs of the user, specifically, the front the outer side, and the back of the right leg of the user as the first right slit 11 being positioned offset from the second right slit 12 about the right leg portion 6. The first right slit 11 and the second right slit 12 traverses into the right leg portion 6, thereby ensuring the position of the resistance band 30 around the front, the outer side, and the back of the right leg and reducing any crumpling of the resistance band 30 throughout use. The resistance band 30 always remains connected around the legs of the user while wearing the lower body garment 1 as the resistance band 30 is tethered through the first left slit 9, the second left slit 10, the first right slit 11, and the second right slit 12.

Figure 2:
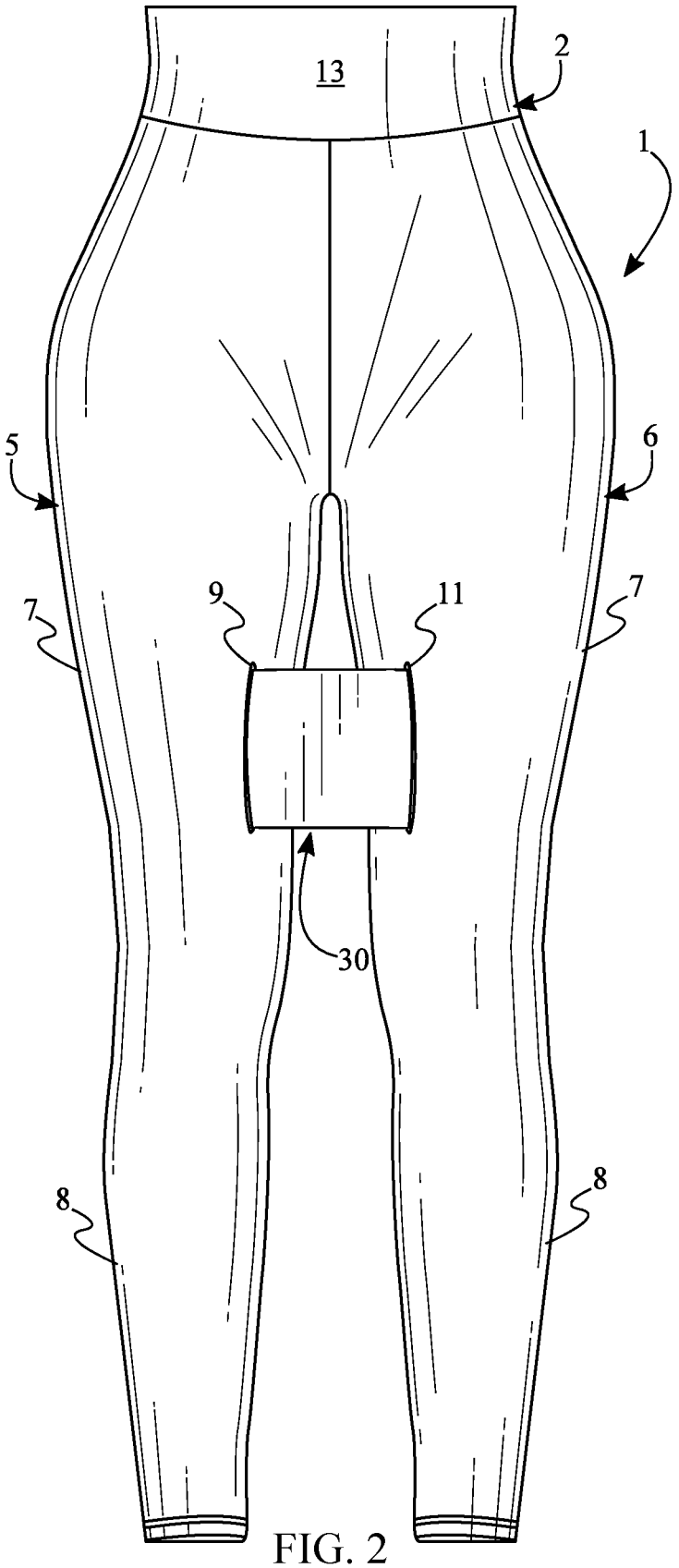
FIG. 2 is a front side view of the preferred embodiment of the present invention.
Figure 3:
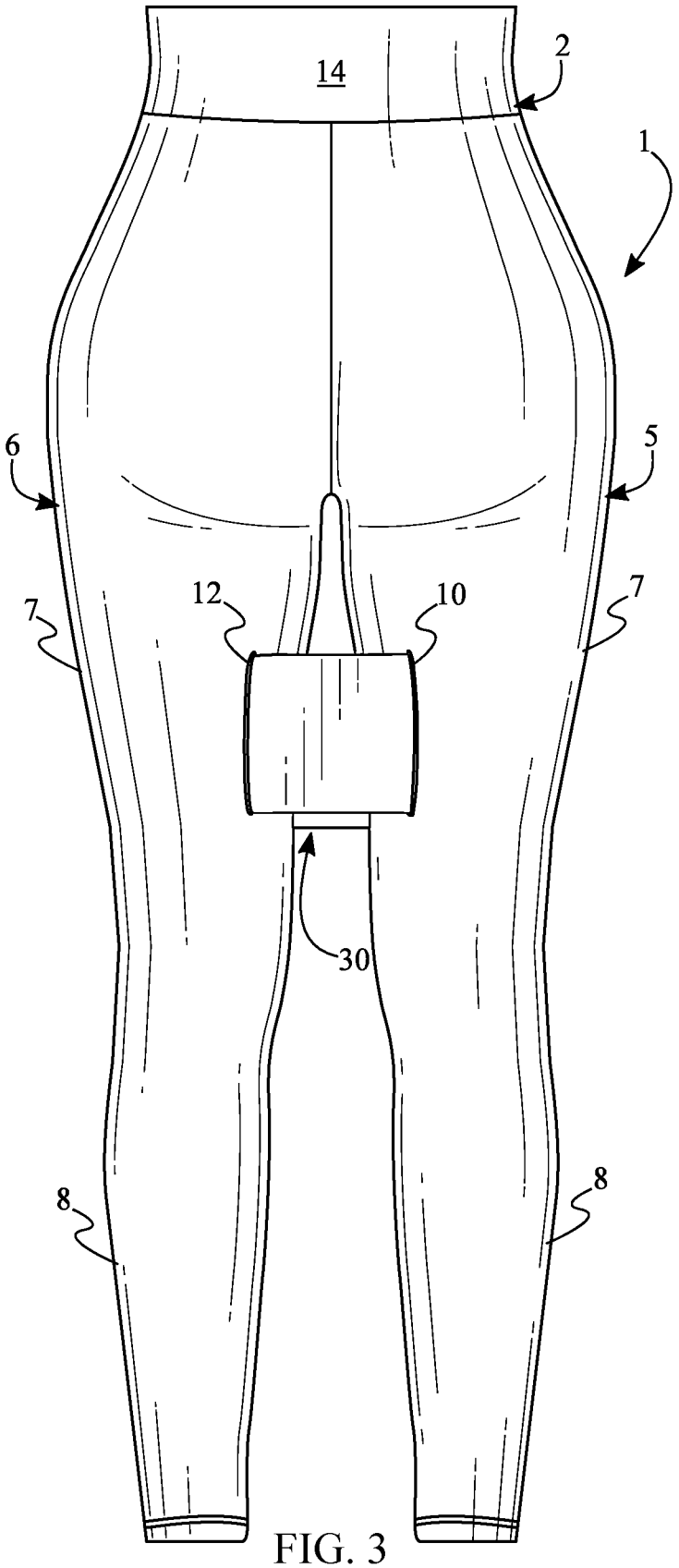
FIG. 3 is a rear side view of the preferred embodiment of the present invention.
Figure 4:
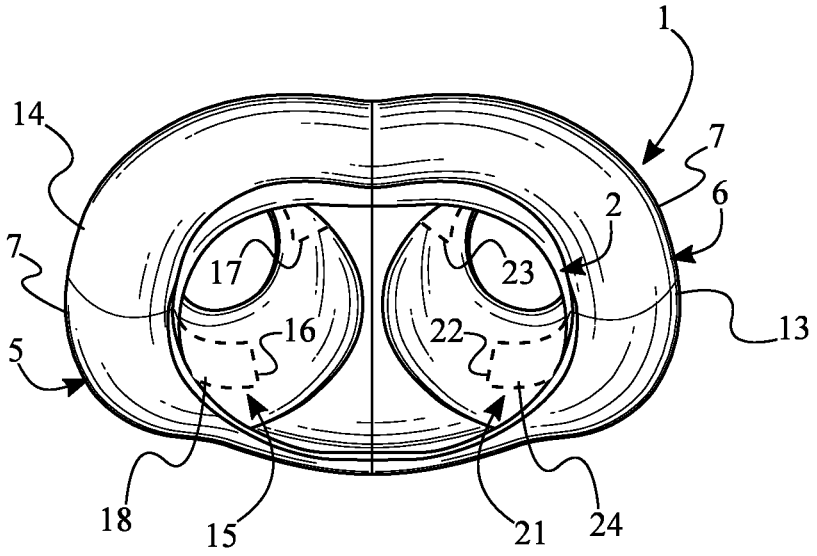
FIG. 4 is a top side view of the preferred embodiment of the present invention.

In order to secure the resistance band 30 to the left leg portion 5 without any additional fasteners, the lower body garment 1 may further comprise a top outer layer 13, an under outer layer 14, and an inner left piece 15, seen in FIG. 2, FIG. 3, and FIG. 4. The top outer layer 13 and the under outer layer 14 define the lower body garment 1 and covers the lower body and the abdominal region of a user from front to back. The inner left piece 15 seals the left leg portion 5 along both the first left slit 9 and the second left slit 10. Furthermore, the inner left piece 15 defines a sleeve for the resistance band 30 through the left leg portion 5. More specifically, the inner left piece 15 comprises a first piece end 16, a second piece end 17, and a left elongated body 18. The first piece end 16 covers the first left slit 9, and the second piece end 17 covers the second left slit 10. The left elongated body 18 covers the resistance band 30 and prevents the resistance band 30 from chaffing the left leg of the user throughout extended use. The lower body garment 1 continuously and smoothly contours to the shape of the body of the user as the top outer layer 13 is positioned coextensive with the under outer layer 14. The user may wear or position the lower body and abdominal region within the lower body garment 1 as the top outer layer 13 is peripherally connected to the under outer layer 14. Moreover, the abdomen portion 2, the left leg portion 5, and the right leg portion 6 are formed from the top outer layer 13 and the under outer layer 14. It is understood that the lower body garment 1 further comprises a left leg rim, a right leg rim, and a waist rim the permits the passage of the left leg and the right leg, respectively, through the left leg portion 5 and the right leg portion 6, respectively. Similarly, the waist rim permits the passage of the lower body and the abdominal region into the lower body garment 1. The length of the left elongated body 18 is defined as the first piece end 16 is positioned opposite the second piece along the left elongated body 18. In order for the resistance band 30 to continuously loop around both legs of the user, the first left slit 9 traverses through the top outer layer 13, and the second left slit 10 traverses through the under outer layer 14. The inner left piece 15 is positioned in between the top outer layer 13 and the under outer layer 14, effectively covering the portions of the leg from the first left slit 9, the second left slit 10, and the left elongated body 18. In order for the resistance band 30 to remain connected around the left leg of the user, a left interior portion 31 of the resistance band 30 traverses into and out of the left leg portion 5. The left interior portion 31 is the portion of the resistance band 30 that is concealed by the left leg portion 5 and is positioned within the left leg portion 5. More specifically, the left interior portion 31 of the resistance band 30 is positioned in between the left elongated body 18 and the left leg portion 5. The left leg portion 5 is sealed as the first piece end 16 is positioned adjacent with the first left slit 9, and the second piece end 17 is positioned adjacent with the second left slit 10. The left elongated body 18 remains connected within the left leg portion 5 as the first piece end 16 is fixed onto the top outer layer 13, and the second piece end 17 is fixed onto the under outer layer 14. This arrangement provides a smooth fit of the inner left piece 15 with the left leg portion 5 around the left leg of the user.

Figure 5:
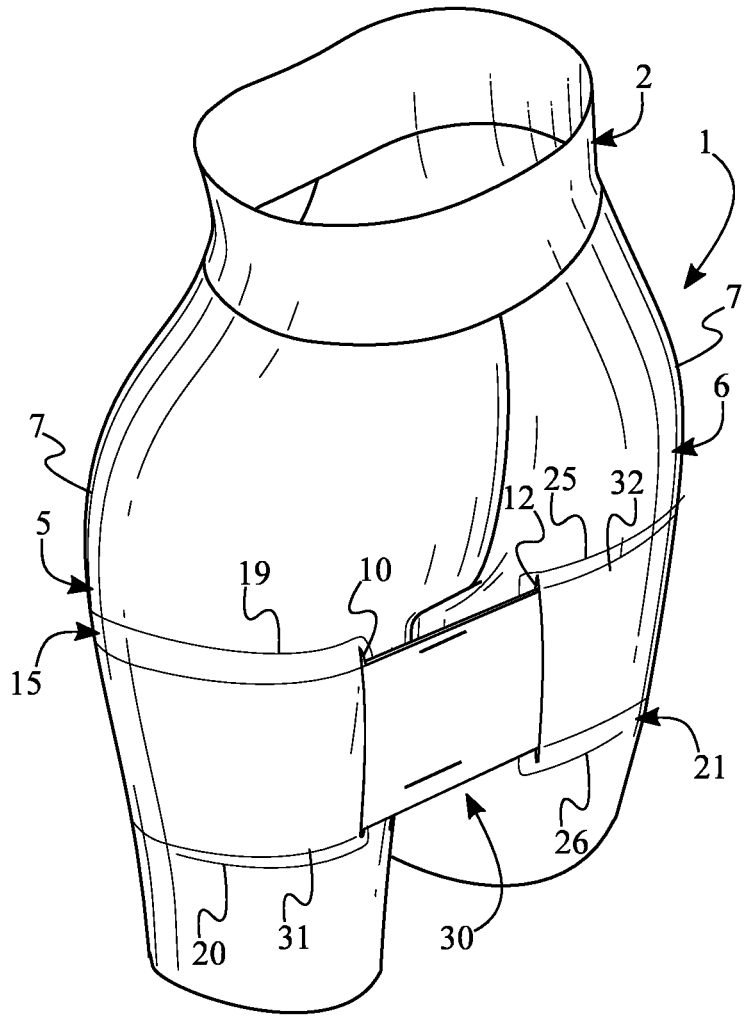
FIG. 5 is a perspective view of an alternate embodiment of the present invention with a lower body garment as a pair of shorts.
Figure 6:
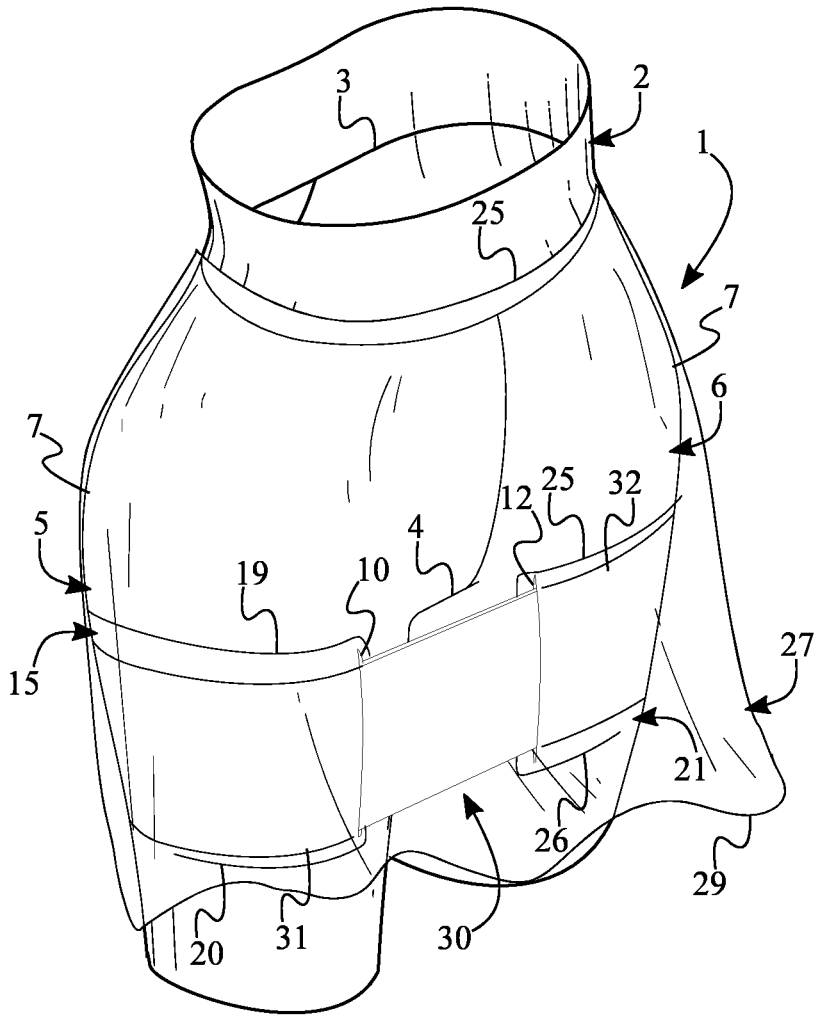
FIG. 6 is a perspective view of an alternate embodiment of the present invention with the lower body garment as a skort.

Furthermore, the inner left piece 15 may further comprise a first lateral edge 19 and a second lateral edge 20, seen in FIG. 1, FIG. 5, and FIG. 6. The first lateral edge 19 is positioned opposite the second lateral edge 20 across the left elongated body 18, thereby defining the width of the left elongated body 18. Moreover, the first lateral edge 19 and the second lateral edge 20 traverse from the first piece end 16 to the second piece end 17. The resistance band 30 remains pressed against the left leg portion 5 as the resistance band 30 is positioned in between the first lateral edge 19 and the second lateral edge 20. The first lateral edge 19 and the second lateral edge 20 is fixed with both the top outer layer 13 and the under outer layer 14, thereby preventing the inner left piece 15 from flapping or moving while positioned within the left leg portion 5. Moreover, this arrangement fully seals the left leg portion 5 and fixes a sleeve for the resistance band 30 through the left leg portion 5.

In order to secure the resistance band 30 to the right leg portion 6 without any additional fasteners, the lower body garment 1 may further comprise a top outer layer 13, an under outer layer 14, and an inner right piece 21, seen in FIG. 2, FIG. 3, and FIG. 4. The top outer layer 13 and the under outer layer 14 define the lower body garment 1 and covers the lower body and the abdominal region of a user from front to back. The inner right piece 21 seals the right leg portion 6 along both the first right slit 11 and the second right slit 12. Furthermore, the inner right piece 21 defines a sleeve for the resistance band 30 through the right leg portion 6. More specifically, the inner right piece 21 comprises a third piece end 22, a fourth piece end 23, and a right elongated body 24. The third piece end 22 covers the first right slit 11, and the fourth piece end 23 covers the second right slit 12. The right elongated body 24 covers the resistance band 30 and prevents the resistance band 30 from chaffing the right leg of the user throughout extended use. The lower body garment 1 continuously and smoothly contours to the shape of the body of the user as the top outer layer 13 is positioned coextensive with the under outer layer 14. The user may wear or position the lower body and abdominal region within the lower body garment 1 as the top outer layer 13 is peripherally connected to the under outer layer 14. Moreover, the abdomen portion 2, the left leg portion 5, and the right leg portion 6 are formed from the top outer layer 13 and the under outer layer 14. It is understood that the lower body garment 1 further comprises a right, leg rim, a right leg rim, and a waist rim the permits the passage of the right leg and the right leg, respectively, through the right leg portion 6 and the right leg portion 6, respectively. Similarly, the waist rim permits the passage of the lower body and the abdominal region into the lower body garment 1. The length of the right elongated body 24 is defined as the third piece end 22 is positioned opposite the fourth piece along the right elongated body 24. In order for the resistance band 30 to continuously loop around both legs of the user, the first right slit 11 traverses through the top outer layer 13, and the second right slit 12 traverses through the under outer layer 14. The inner right piece 21 is positioned in between the top outer layer 13 and the under outer layer 14, effectively covering the portions of the leg from the first right slit 11, the second right slit 12, and the right elongated body 24. In order for the resistance band 30 to remain connected around the right leg of the user, a right interior portion 32 of the resistance band 30 traverses into and out of the right leg portion 6. The right interior portion 32 is the portion of the resistance band 30 that is concealed by the right leg portion 6 and is positioned within the right leg portion 6. More specifically, the right interior portion 32 of the resistance band 30 is positioned in between the right elongated body 24 and the right leg portion 6. The right leg portion 6 is sealed as the third piece end 22 is positioned adjacent with the first right slit 11, and the fourth piece end 23 is positioned adjacent with the second right slit 12. The right elongated body 24 remains connected within the right leg portion 6 as the third piece end 22 is fixed onto the top outer layer 13, and the fourth piece end 23 is fixed onto the under outer layer 14. This arrangement provides a smooth fit of the inner right piece 21 with the right leg portion 6 around the right leg of the user.

Furthermore, the inner right piece 21 may further comprise a third lateral edge 25 and a fourth lateral edge 26, seen in FIG. 1, FIG. 5, and FIG. 6. The third lateral edge 25 is positioned opposite the fourth lateral edge 26 across the right elongated body 24, thereby defining the width of the right elongated body 24. Moreover, the third lateral edge 25 and the fourth lateral edge 26 traverse from the third piece end 22 to the fourth piece end 23. The resistance band 30 remains pressed against the right leg portion 6 as the resistance band 30 is positioned in between the third lateral edge 25 and the fourth lateral edge 26. The third lateral edge 25 and the fourth lateral edge 26 is fixed with both the top outer layer 13 and the under outer layer 14, thereby preventing the inner right piece 21 from flapping or moving while positioned within the right leg portion 6. Moreover, this arrangement fully seals the right leg portion 6 and fixes a sleeve for the resistance band 30 through the right leg portion 6.

In a preferred embodiment of the present invention, the left leg portion 5 and the right leg portion 6 each comprise an upper-leg sleeve 7 and a lower-leg sleeve 8, seen in FIG. 1, FIG. 2, and FIG. 3. The upper-leg sleeve 7 wraps around the thigh portion of the leg, and the lower-leg sleeve 8 wraps around the calf portion of the leg. Moreover, the preferred embodiment of the lower body garment 1 is a pair of exercise pants or leggings pants. The lower body garment 1 is preferably a pair of yoga pants. The lower-leg sleeve 8 may fully extend to the ankles of the user or partially extend towards the ankles of a user for a capri style. In order to provide coverage for the legs of a user, the abdomen portion 2 is terminally fixed around the upper-leg sleeve 7, and the lower-leg sleeve 8 is terminally fixed around the upper-leg sleeve 7, opposite to the abdomen portion 2. Lower body workouts are made more efficient as the first left slit 9 and the second left slit 10 are positioned coincident with the upper-leg sleeve 7 of the left leg portion 5. Similarly, the first right slit 11 and the second right slit 12 are positioned coincident with the upper-leg sleeve 7 of the right leg portion 6. This positions the resistance against the thighs of the user. It is understood in alternate embodiments that a secondary resistance band 30 may be integrated through the lower-leg sleeve 8 of the left leg portion 5 and the lower-leg sleeve 8 of the right leg portion 6 to further enhance a workout.

In an alternate embodiment of the present invention, the left leg portion 5 is a left upper-leg sleeve 7, and the right leg portion 6 is a right upper-leg sleeve 7, seen in FIG. 5. The left upper-leg sleeve 7 wraps around the left thigh, and the right upper-leg sleeve 7 wraps around the right thigh. In this alternate embodiment of the present invention, the lower body garment 1 is a pair of shorts. The pair of shorts is also preferably yoga shorts. The length of the left upper-leg sleeve 7 and the length of the right upper-leg sleeve 7 may vary to provide short shorts, mid-length shorts, or knee-length shorts.

Figure 7:
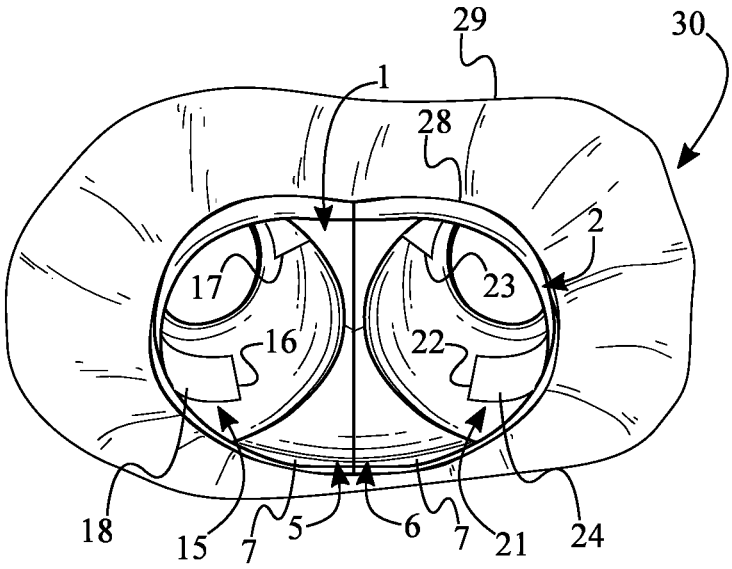
FIG. 7 is a top side view of the alternate embodiment of the present invention with the lower body garment as a skort.

In another embodiment of the present invention, the lower body garment 1 further comprises a skirt portion 27, seen in FIG. 7 and FIG. 8. Moreover, the abdomen portion 2 comprising a waist end 3 and a crotch end 4. The waist end 3 surrounds the waist of the user, and the crotch end 4 surrounds the crotch of the user. The skirt portion 27 provides additional coverage around the buttocks and crotch area of the user. The skirt portion 27 is preferably an A-line skirt. Moreover, in this alternate embodiment of the present invention, the lower body garment 1 is a skort or a "skipri". The skirt portion 27 is preferably free flowing to allow for a full range of motion. The skirt portion 27 comprises a waistline edge 28 and a hemline edge 29. The waistline edge 28 is positioned around the waist of the user, and the hemline edge 29 is positioned around the legs of the user. The skirt portion 27 accents the lower body garment 1 as the skirt portion 27 is externally positioned around the abdomen portion 2. This arrangement also allows the abdomen portion 2, the left leg portion 5, and the right leg portion 6 to smoothly and continuously press around the body of the user. The waist end 3 is positioned opposite the crotch end 4 about the abdomen portion 2, effectively contouring around the body of the user. Moreover, the crotch end 4 is positioned adjacent with both the left leg portion 5 and the right leg portion 6. The waistline edge 28 is positioned opposite the hemline edge 29 about the skirt portion 27, defining an overall length for the skirt portion 27. The skirt is free flowing around the abdomen portion 2, the left leg portion 5, and the right leg portion 6 as the waistline edge 28 is fixed around the waist end 3.

Although the invention has been explained in relation to its preferred embodiment, it is to be understood that many other possible modifications and variations can be made without departing from the spirit and scope of the invention as hereinafter claimed.

What is claimed is:

1. A lower body garment with an integrated resistance band comprising:

a lower body garment;

a resistance band;

the lower body garment comprising an abdomen portion, a left leg portion, a right leg portion, a first left slit, a second left slit, a first right slit, and a second right slit;

the left leg portion being positioned adjacent with the right leg portion;

the abdomen portion being positioned adjacent with the left leg portion and the right leg portion;

the abdomen portion being terminally fixed around the left leg portion;

the abdomen portion being terminally fixed around the right leg portion;

the first left slit being positioned offset from the second left slit about the left leg portion;

the first left slit and the second left slit traversing into the left leg portion;

the first right slit being positioned offset from the second right slit about the right leg portion;

the first right slit and the second right slit traversing into the right leg portion; and, the resistance band being tethered through the first left slit, the second left slit, the first right slit, and the second right slit.

2. The lower body garment with an integrated resistance band as claimed in claim 1 comprising:

the lower body garment further comprising a top outer layer, an under outer layer, and an inner left piece;

the inner left piece comprising a first piece end, a second piece end, and a left elongated body;

the top outer layer being positioned coextensive with the under outer layer;

the top outer layer being peripherally connected to the under outer layer;

the abdomen portion, the left leg portion, and the right leg portion being formed from the top outer layer and the under outer layer;

the first piece end being positioned opposite the second piece end along the left elongated body;

the first left slit traversing through the top outer layer;

the second left slit traversing through the under outer layer;

the inner left piece being positioned in between the top outer layer and the under outer layer;

a left interior portion of the resistance band traversing into and out of the left leg portion;

the left interior portion of the resistance band being positioned in between the left elongated body and the left leg portion;

the first piece end being positioned adjacent with the first left slit;

the second piece end being positioned adjacent with the second left slit;

the first piece end being fixed onto the top outer layer; and, the second piece end being fixed onto the under outer layer.

3. The lower body garment with an integrated resistance band as claimed in claim 2 comprising:

the inner left piece further comprising a first lateral edge and a second lateral edge;

the first lateral edge being positioned opposite the second lateral edge across the left elongated body;

the first lateral edge and the second lateral edge traversing from the first piece end to the second piece end;

the resistance band being positioned between the first lateral edge and the second lateral edge; and, the first lateral edge and the second lateral edge being fixed with both the top outer layer and the under outer layer.

4. The lower body garment with an integrated resistance band as claimed in claim 1 comprising:

the lower body garment further comprising a top outer layer, an under outer layer, and an inner right piece;

the inner right piece comprising a third piece end, a fourth piece end, and a right elongated body;

the top outer layer being positioned coextensive with the under outer layer;

the top outer layer being peripherally connected to the under outer layer;

the abdomen portion, the left leg portion, and the right leg portion being formed from the top outer layer and the under outer layer;

the third piece end being positioned opposite the fourth piece end along the right elongated body;

the first right slit traversing through the top outer layer;

the second right slit traversing through the under outer layer;

the inner right piece being positioned in between the top outer layer and the under outer layer;

a right interior portion of the resistance band traversing into and out of the right leg portion;

the right interior portion of the resistance band being positioned in between the right elongated body and the right leg portion;

the third piece end being positioned adjacent with the first right slit;

the fourth piece end being positioned adjacent with the second right slit;

the third piece end being fixed onto the top outer layer; and, the fourth piece end being fixed onto the under outer layer.

5. The lower body garment with an integrated resistance band as claimed in claim 4 comprising:

the inner right piece further comprising a third lateral edge and a fourth lateral edge;

the third lateral edge being positioned opposite the fourth lateral edge across the right elongated body;

the third lateral edge and the fourth lateral edge traversing from the third piece end to the fourth piece end;

the resistance band being positioned between the third lateral edge and the fourth lateral edge; and, the third lateral edge and the fourth lateral edge being fixed with both the top outer layer and the under outer layer.

6. The lower body garment with an integrated resistance band as claimed in claim 1 comprising:

the left leg portion and the right leg portion each comprising an upper-leg sleeve and a lower-leg sleeve;

the abdomen portion being terminally fixed around each upper-leg sleeve;

each lower-leg sleeve being terminally fixed around the respective upper-leg sleeve, opposite to the abdomen portion;

the first left slit and the second left slit being positioned coincident with the upper-leg sleeve of the left leg portion; and, the first right slit and the second right slit being positioned coincident with the upper-leg sleeve of the right leg portion.

7. The lower body garment with an integrated resistance band as claimed in claim 1, wherein the left leg portion is a left upper-leg sleeve, and wherein the right leg portion is a right upper-leg sleeve.

8. The lower body garment with an integrated resistance band as claimed in claim 1 comprising:

the lower body garment further comprising a skirt portion;

the abdomen portion comprising a waist end and a crotch end;

the skirt portion comprising a waistline edge and a hemline edge;

the skirt portion being externally positioned around the abdomen portion;

the waist end being positioned opposite the crotch end about the abdomen portion;

the crotch end being positioned adjacent with both the left leg portion and the right leg portion;

the waistline edge being positioned opposite the hemline edge about the skirt portion; and, the waistline edge being fixed around the waist end.

9. A lower body garment with an integrated resistance band comprising:

a lower body garment;

a resistance band;

the lower body garment comprising an abdomen portion, a left leg portion, a right leg portion, a first left slit, a second left slit, a first right slit, a second right slit, and a skirt portion;

the abdomen portion comprising a waist end and a crotch end;

the skirt portion comprising a waistline edge and a hemline edge;

the left leg portion being positioned adjacent with the right leg portion;

the abdomen portion being positioned adjacent with the left leg portion and the right leg portion;

the abdomen portion being terminally fixed around the left leg portion;

the abdomen portion being terminally fixed around the right leg portion;

the first left slit being positioned offset from the second left slit about the left leg portion;

the first left slit and the second left slit traversing into the left leg portion;

the first right slit being positioned offset from the second right slit about the right leg portion;

the first right slit and the second right slit traversing into the right leg portion;

the resistance band being tethered through the first left slit, the second left slit, the first right slit, and the second right slit;

the skirt portion being externally positioned around the abdomen portion;

the waist end being positioned opposite the crotch end about the abdomen portion;

the crotch end being positioned adjacent with both the left leg portion and the right leg portion;

the waistline edge being positioned opposite the hemline edge about the skirt portion; and, the waistline edge being fixed around the waist end.

10. The lower body garment with an integrated resistance band as claimed in claim 9 comprising:

the lower body garment further comprising a top outer layer, an under outer layer, and an inner left piece;

the inner left piece comprising a first piece end, a second piece end, and a left elongated body;

the top outer layer being positioned coextensive with the under outer layer;

the top outer layer being peripherally connected to the under outer layer;

the abdomen portion, the left leg portion, and the right leg portion being formed from the top outer layer and the under outer layer;

the first piece end being positioned opposite the second piece end along the left elongated body;

the first left slit traversing through the top outer layer;

the second left slit traversing through the under outer layer;

the inner left piece being positioned in between the top outer layer and the under outer layer;

a left interior portion of the resistance band traversing into and out of the left leg portion;

the left interior portion of the resistance band being positioned in between the left elongated body and the left leg portion;

the first piece end being positioned adjacent with the first left slit;

the second piece end being positioned adjacent with the second left slit;

the first piece end being fixed onto the top outer layer; and, the second piece end being fixed onto the under outer layer.

11. The lower body garment with an integrated resistance band as claimed in claim 10 comprising:

the inner left piece further comprising a first lateral edge and a second lateral edge;

the first lateral edge being positioned opposite the second lateral edge across the left elongated body;

the first lateral edge and the second lateral edge traversing from the first piece end to the second piece end;

the resistance band being positioned between the first lateral edge and the second lateral edge; and, the first lateral edge and the second lateral edge being fixed with both the top outer layer and the under outer layer.

12. The lower body garment with an integrated resistance band as claimed in claim 9 comprising:

the lower body garment further comprising a top outer layer, an under outer layer, and an inner right piece;

the inner right piece comprising a third piece end, a fourth piece end, and a right elongated body;

the top outer layer being positioned coextensive with the under outer layer;

the top outer layer being peripherally connected to the under outer layer;

the abdomen portion, the left leg portion, and the right leg portion being formed from the top outer layer and the under outer layer;

the third piece end being positioned opposite the fourth piece end along the right elongated body;

the first right slit traversing through the top outer layer;

the second right slit traversing through the under outer layer;

the inner right piece being positioned in between the top outer layer and the under outer layer;

a right interior portion of the resistance band traversing into and out of the right leg portion;

the right interior portion of the resistance band being positioned in between the right elongated body and the right leg portion;

the third piece end being positioned adjacent with the first right slit;

the fourth piece end being positioned adjacent with the second right slit;

the third piece end being fixed onto the top outer layer; and, the fourth piece end being fixed onto the under outer layer.

13. The lower body garment with an integrated resistance band as claimed in claim 12 comprising:

the inner right piece further comprising a third lateral edge and a fourth lateral edge;

the third lateral edge being positioned opposite the fourth lateral edge across the right elongated body;

the third lateral edge and the fourth lateral edge traversing from the third piece end to the fourth piece end;

the resistance band being positioned between the third lateral edge and the fourth lateral edge; and, the third lateral edge and the fourth lateral edge being fixed with both the top outer layer and the under outer layer.

14. The lower body garment with an integrated resistance band as claimed in claim 9 comprising:

the left leg portion and the right leg portion each comprising an upper-leg sleeve and a lower-leg sleeve;

the abdomen portion being terminally fixed around each upper-leg sleeve;

each lower-leg sleeve being terminally fixed around the respective upper-leg sleeve, opposite to the abdomen portion;

the first left slit and the second left slit being positioned coincident with the upper-leg sleeve of the left leg portion; and, the first right slit and the second right slit being positioned coincident with the upper-leg sleeve of the right leg portion.

15. The lower body garment with an integrated resistance band as claimed in claim 9, wherein the left leg portion is a left upper-leg sleeve, and wherein the right leg portion is a right upper-leg sleeve.

* * * * *